US008033023B2

(12) United States Patent
Johnson et al.

(10) Patent No.: US 8,033,023 B2
(45) Date of Patent: Oct. 11, 2011

(54) SHAVING RAZORS AND CARTRIDGES

(75) Inventors: Robert Johnson, Melrose, MA (US); Robert A. Trotta, Pembroke, MA (US); Kelly Bridges, N. Quincy, MA (US)

(73) Assignee: The Gillette Company, Boston, MA (US)

( * ) Notice: Subject to any disclaimer, the term of this patent is extended or adjusted under 35 U.S.C. 154(b) by 1469 days.

(21) Appl. No.: 10/969,392

(22) Filed: Oct. 20, 2004

(65) Prior Publication Data

US 2006/0080838 A1 Apr. 20, 2006

(51) Int. Cl.
*B26B 21/00* (2006.01)

(52) U.S. Cl. ..... 30/50; 30/51; 30/57; 30/526

(58) Field of Classification Search ..... 30/32, 50, 30/526–532, 51, 57–61, 34.2, 40.2
See application file for complete search history.

(56) References Cited

U.S. PATENT DOCUMENTS

| | | | | |
|---|---|---|---|---|
| 3,935,639 | A | 2/1976 | Terry et al. | |
| 3,950,849 | A | 4/1976 | Perry | |
| 4,258,471 | A * | 3/1981 | Jacobson | 30/530 |
| 4,403,414 | A | 9/1983 | Kiraly | |
| 4,488,357 | A | 12/1984 | Jacobson | |
| 4,492,025 | A | 1/1985 | Jacobson | |
| 4,498,235 | A | 2/1985 | Jacobson | |
| 4,573,266 | A | 3/1986 | Jacobson | |
| 4,586,255 | A | 5/1986 | Jacobson | |
| 4,756,082 | A | 7/1988 | Apprille | |
| 4,785,534 | A | 11/1988 | Lazarchik | |
| 5,347,717 | A | 9/1994 | Tsai et al. | |
| 5,661,907 | A | 9/1997 | Apprille, Jr. | |
| 5,855,071 | A | 1/1999 | Apprille, Jr. et al. | |
| 5,956,851 | A | 9/1999 | Apprille, Jr. et al. | |
| 6,052,903 | A | 4/2000 | Metcalf et al. | |
| 6,112,412 | A | 9/2000 | Richard et al. | |
| 6,122,826 | A | 9/2000 | Coffin et al. | |

FOREIGN PATENT DOCUMENTS

| | | |
|---|---|---|
| DE | 3518703 | 11/1986 |
| DE | 3635553 | 4/1988 |
| GB | 1460732 | 1/1977 |

OTHER PUBLICATIONS

Written Opinion in corresponding Int'l appln. PCT/US2005/036543 dated Mar. 3, 2006.
PCT International Search Report in corresponding Int'l appln. PCT/US2005/036543 dated Mar. 3, 2006.

* cited by examiner

*Primary Examiner* — Phong H Nguyen
(74) *Attorney, Agent, or Firm* — Joanne N. Pappas; Kevin C. Johnson; Steven W. Miller

(57) ABSTRACT

Connecting structures are provided, for connecting a cartridge to a handle in a shaving razor, e.g., a razor for wet shaving. A cartridge connecting a structure includes a molded body, and a blade unit receiving portion having a shell bearing structure that pivotally receives a blade unit, the shell bearing structure comprising a pair of shell bearings. The cartridge connecting structure further includes a spring return for biasing the blade unit relative to the cartridge connecting structure, the spring return being positioned between the shell bearings and extending integrally from the molded body of the cartridge connecting structure.

9 Claims, 8 Drawing Sheets

SHAVING RAZORS AND CARTRIDGES

TECHNICAL FIELD

This invention relates to shaving razors having replaceable cartridges, and cartridges for such razors.

BACKGROUND

Shaving systems often consist of a handle and a replaceable cartridge in which one or more blades are mounted in a plastic housing. After the blades in a cartridge have become dull from use, the cartridge is discarded, and replacd on the handle with a new cartridge. In some shaving systems the connection of the cartridge to the handle provides a pivotal mounting of the cartridge with respect to the handle so that the cartridge angle adjusts to follow the contours of the surface being shaved. In such systems, the cartridge can be biased toward an at rest position by the action of a spring-biased plunger (a cam follower) carried on the handle against a cam surface on the cartridge housing.

SUMMARY

In one aspect, the invention features, in general, a replaceable razor blade cartridge that includes a blade unit and cartridge connecting structure for connecting the blade unit to a handle. The cartridge connecting structure has inwardly directed surfaces that partially define a handle-receiving region and mate with outwardly directed surfaces on a handle connecting structure of the handle. The cartridge connecting structure also has a connection entrance to the handle-receiving region, and a projection that extends into the handle-receiving region. The projection has a blocking surface facing the opposite direction from the connection entrance to retain the handle connecting structure on the cartridge connecting structure. The cartridge connecting structure also includes a blade unit receiving portion having a shell bearing structure that pivotally receives the blade unit.

Certain implementations of the invention include one or more of the following features. In certain implementations the cartridge connecting structure includes a latching member having a projection with a blocking surface that blocks retraction of the handle connecting structure from the cartridge connecting structure when in a latched position and permits retraction of the handle connecting structure from the cartridge connecting structure when in an unlatched position. The latching member may include engagement structure that is movable from an initial position to a deflected position, the blocking surface moving from the latched position to the unlatched position as the engagement structure is moved from the initial position to the deflected position. The handle connecting structure of the handle may have an ejector that is extendible from the handle, and the engagement structure may be aligned with the ejector. The cartridge connecting structure may include a spring return, e.g., a spring having a bent portion.

In another aspect, the invention features, in general, shaving razors including cartridges as have already been described and handles connected to the cartridges.

In another aspect, the invention features, in general, methods of connecting replaceable shaving cartridges as have already been described to handles and disconnecting the cartridges from the handles by moving latching members to release the cartridges from the handles.

Embodiments of the invention may include one or more of the following advantages. The use of a latching member permits the cartridge to be securely attached to the handle with little likelihood of unintended detachment during use. In addition the cartridge can be released and removed from the handle with little force when it is desired to replace the cartridge.

The details of one or more embodiments of the invention are set forth in the accompanying drawings and the description below. Other features and advantages of the invention will be apparent from the description and drawings, and from the claims.

DETAILED DESCRIPTION

Figure 1:
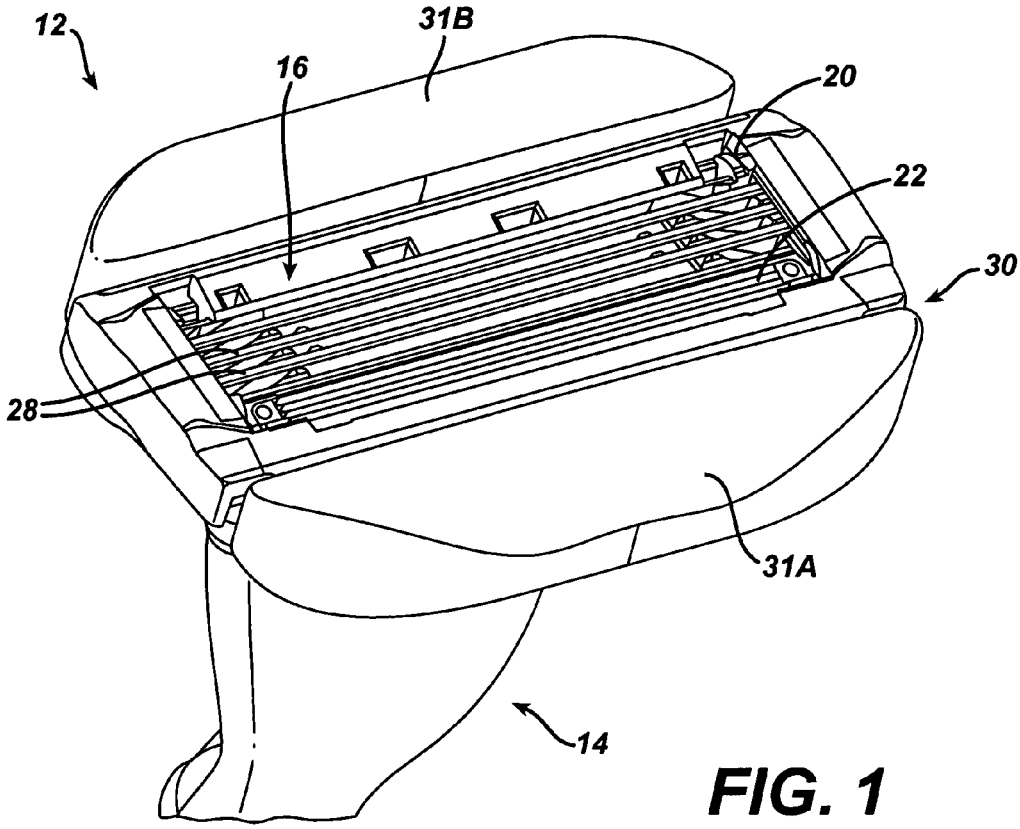
FIG. 1 is a perspective view of the head and neck portion of a razor according to one embodiment of the invention.
Figure 1A:
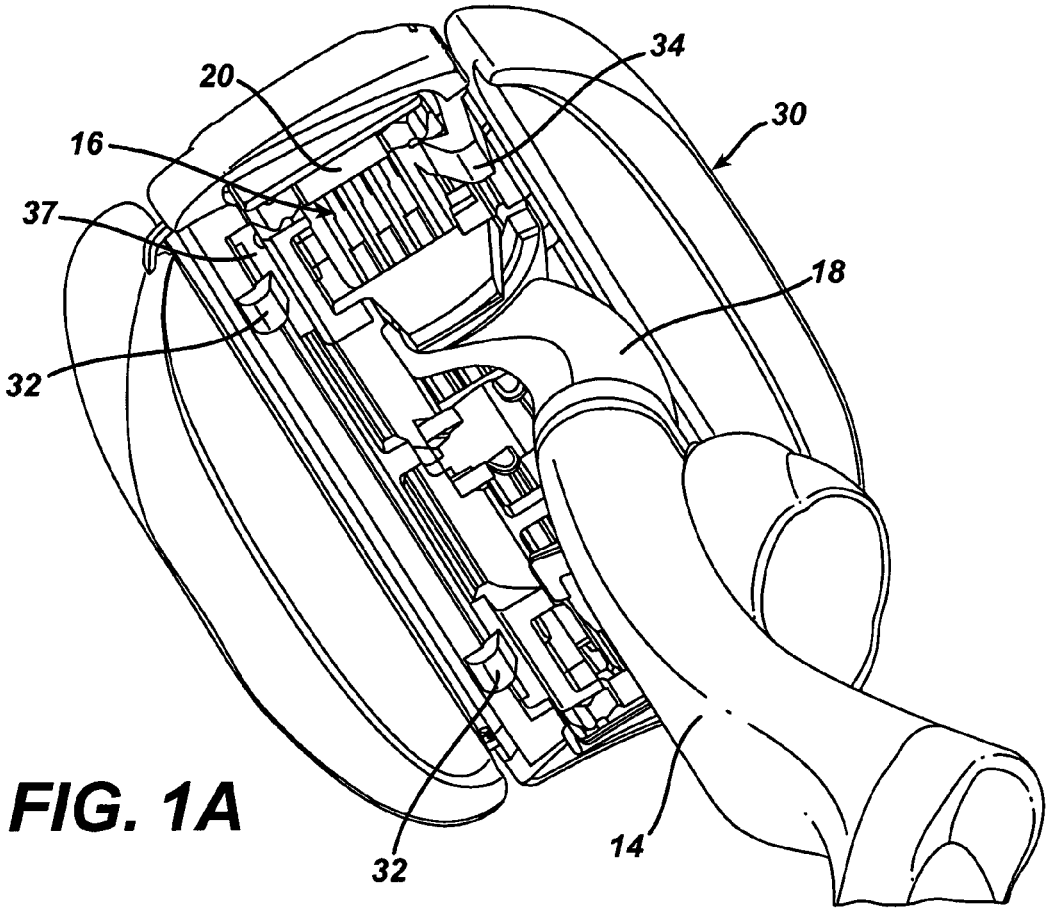
FIG 1A is a perspective view of the head and neck portion shown in FIG. 1, viewed from the back.
Figure 2:
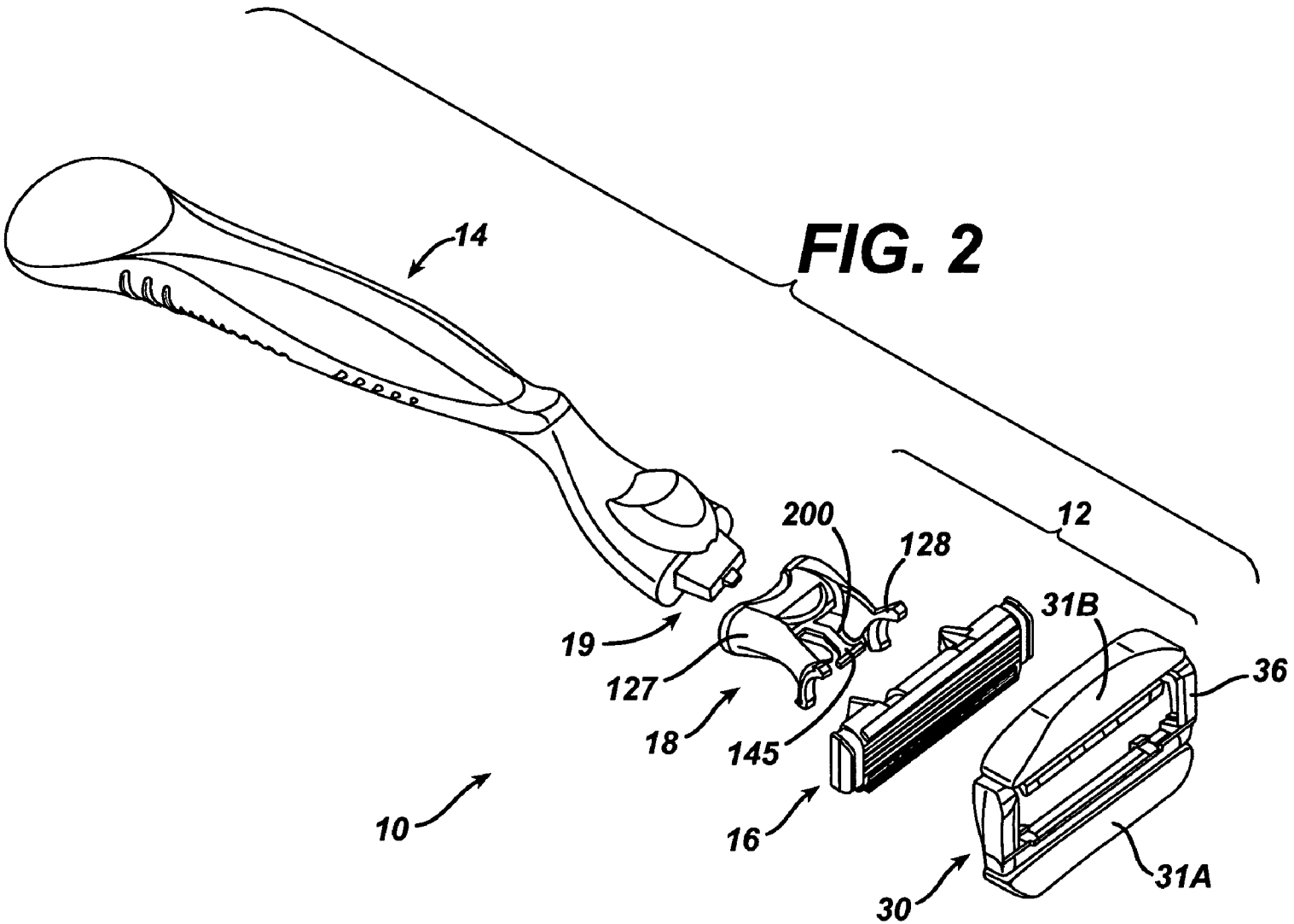
FIG. 2 is an exploded perspective view of the razor of FIG. 1.

Referring to FIGS. 1 and 2, a shaving razor 10 includes a disposable cartridge 12 and a handle 14. As shown in FIG. 2, cartridge 12 includes a connecting member 18, which removably connects cartridge 12 to a connecting portion 19 of handle 14, and a blade unit 16, which is pivotally connected to connecting member 18. Optionally, the cartridge may include a shaving aid holder 30 mounted on the blade unit 16. Shaving aid holder 30 is described in U.S. Ser. No. 10/969,373, titled Shaving Razors and Cartridges, filed on the same date as this application. Referring to FIG. 1, the blade unit 16 includes a plastic housing 20, a guard 22 at the front of housing 20, and blades 28 between guard 22 and the rear of housing 20.

The blade unit 16 is similar to blade units described in U.S. Pat. No. 5,661,907, the complete disclosure of which is incorporated herein by reference. The handle 14 is similar to those described in U.S. Pat. Nos. 5,855,071, 5,956,851 and 6,052,903, the complete disclosures of which are incorporated herein by reference. The connecting member 18 that is used to connect blade unit 16 to handle 14 is discussed below.

As discussed above, referring to FIGS. 1 and 2, razor 10 includes a disposable cartridge 12 and a handle 14. As shown in FIG. 2, cartridge 12 includes a connecting member 18, which removably connects cartridge 12 to a connecting portion 19 of handle 14, and a blade unit 16, which is pivotally connected to connecting member 18.

Figure 3:
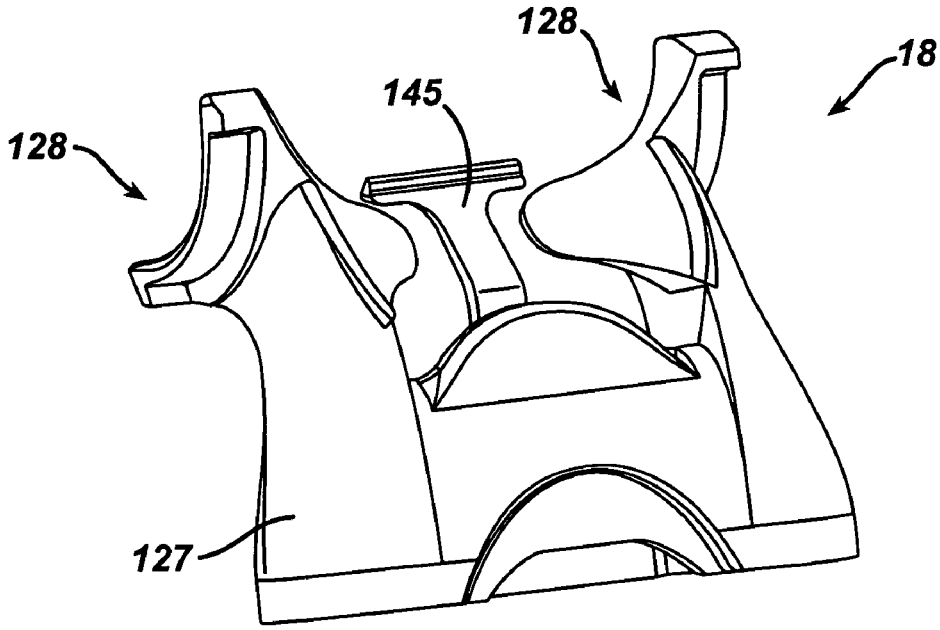
FIGS. 3 and 3A are perspective views of a connecting member used to connect the cartridge to the handle in the razor shown in FIG. 1, taken from different angles.
Figure 3A:
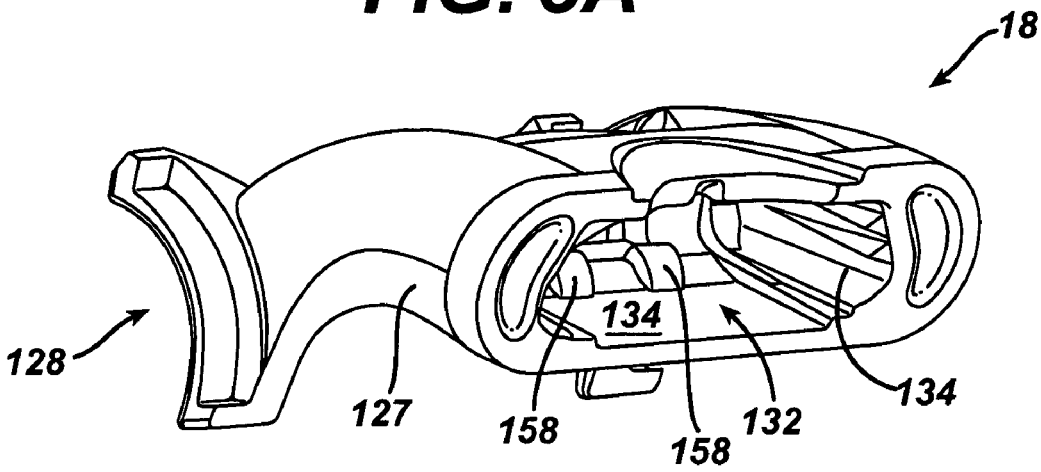
Figure 5:
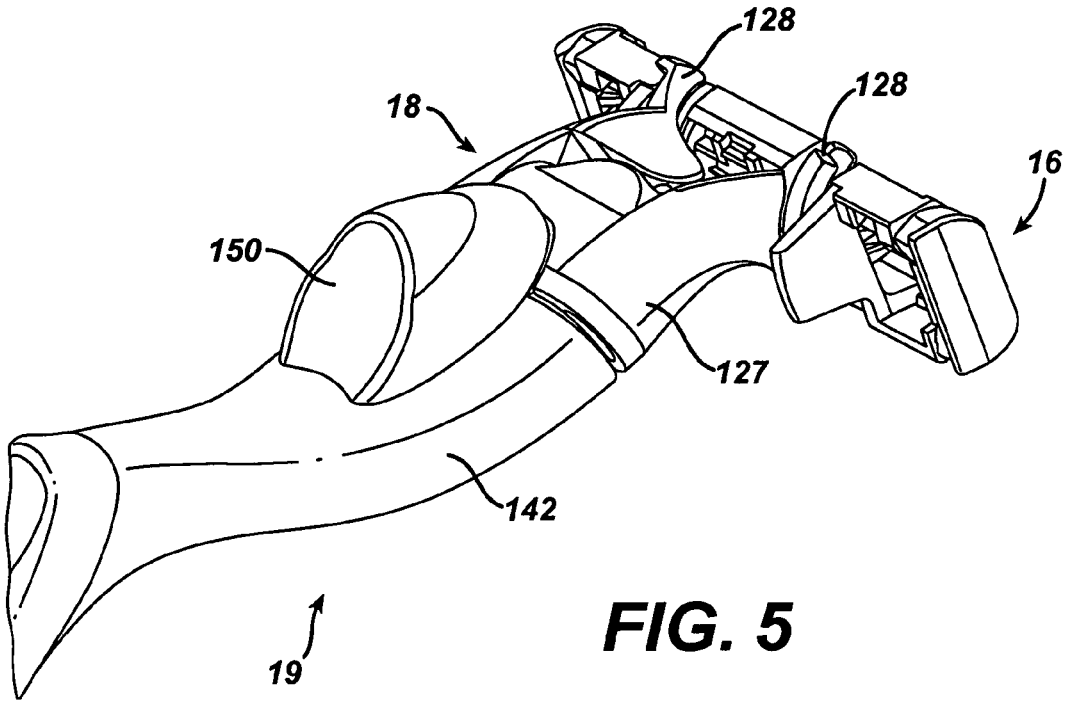
FIG. 5 is a perspective view, taken from the rear, of the blade unit of FIGS. 4 and 4A connected to a handle by the connecting member shown in FIGS. 3 and 3A.

Connecting member 18 is shown in detail in FIGS. 3-3A. Connecting member 18 includes a base 127, which removably and fixedly attaches to an extension 126 (FIG. 6) on handle 14, and two arms 128 that pivotally support blade unit 16 at its two sides, as shown in FIG. 5. Thus, base 127 connects to the connecting portion 19 of handle 14, while arms 128 connect to the blade unit 16, as will be discussed in further detail below. A flexible spring return 145 extends from base 127 and acts against a cam surface on blade unit 16, causing the blade unit 16 to have a forward-biased at-rest orientation. As shown in FIG. 2, the spring return includes a bend 200 that facilitates molding of the base 127.

First, the connection of the arms 128 to the blade unit 16 will be described, with reference to FIGS. 3-5.

Figure 4:
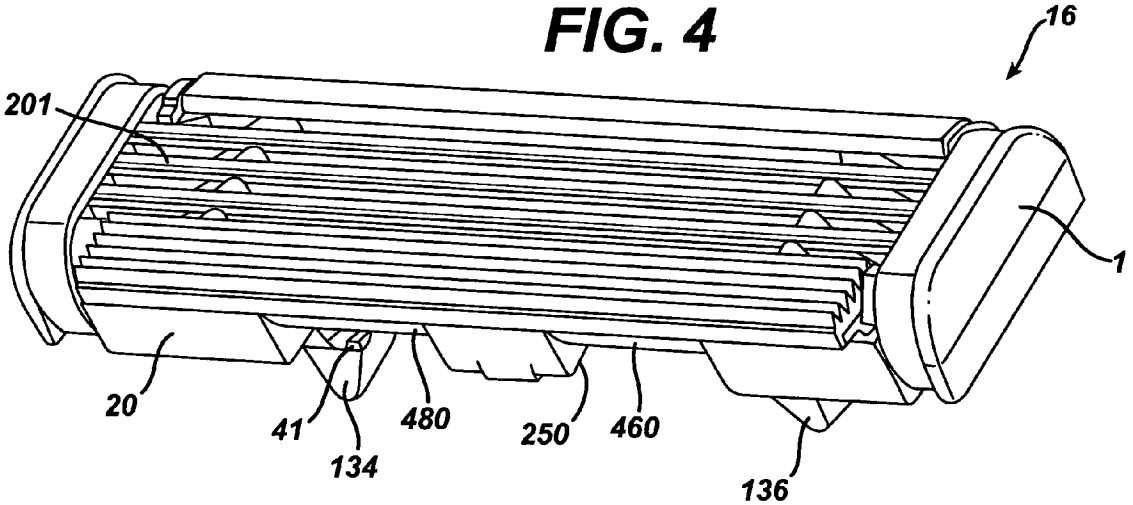
FIGS. 4 and 4A are, respectively, perspective and end views of the blade unit of the razor shown in FIG. 1.
Figure 4A:
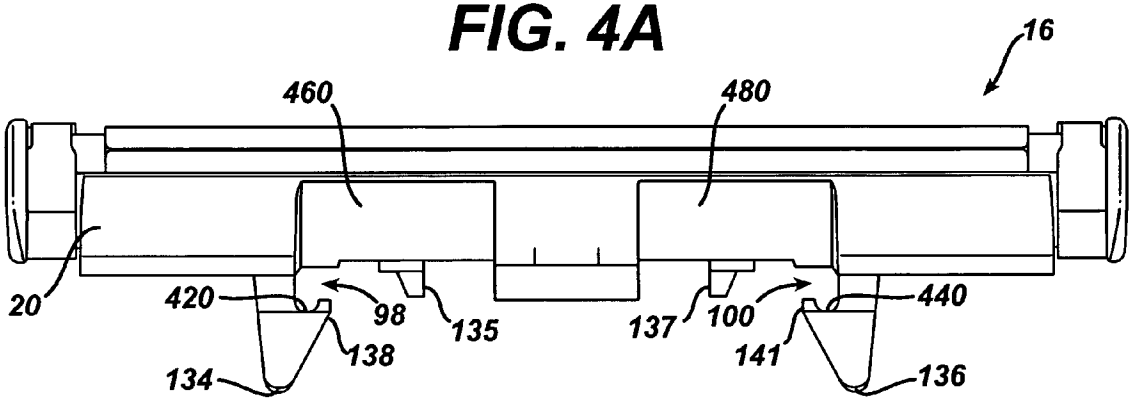

Referring first to FIG. 4A, extensions 134, 136 are located at the bottom of housing 20 of the blade unit. Extensions 134, 136 carry inwardly extending opposed curved rails 138, 141 having respective curved surfaces 420, 440. The undersurfaces 460, 480 of housing 20 are similarly curved and provide, with extensions 134, 136, a pivotal connecting structure, as described in detail in U.S. Pat. Nos. 4,488,357; 4,498,235; 4,492,025; 4,573,266; 4,586,255, 4,756,082 which are hereby incorporated by reference.

The curved rails 138, 141, in conjunction with undersurfaces 460, 480 of housing 20, define arcuate slots 98, 100, which are adapted to receive arms 128 of connecting member 18 (FIG. 3). Arms 128 define shell bearing surfaces which engage undersurfaces 460, 480. Thus, arms 128 or "shell bearings" cooperate with the surfaces 460, 480 to facilitate pivotal connection of the blade assembly to the razor handle 14. This mating engagement is referred to herein as a "shell bearing connection."

The top surfaces of rails 138, 141 and housing undersurfaces 460, 480 have radii of curvature about a pivot axis, which may be, for example, located at the cutting edge of the second blade 201 of the blade unit (FIG. 4). The curved surfaces 420, 440 of extensions 134, 136 are similarly curved about the pivot axis. Shaving aid holder 30 includes cut out areas (not shown) to provide clearance for the pivoting movement provided by these complementary surfaces.

The shell bearings have stop surfaces (not shown) that provide a forward pivot stop position and a rearward pivot stop position, as described in U.S. Pat. No. 5,661,907. The shell bearings also have recesses (not shown) that mate with stop surfaces 135, 137 (FIG. 4A) formed on the respective curved undersurfaces 460, 480 to complement the rearward pivot stop position to prevent further "downward" travel.

Referring to FIG. 4, cam surface 250 is formed in the bottom of housing 20. Surface 250 has two oppositely inclined surfaces of the same size and an apex located at a position midway between the front and the back of cam surface 250. Cam surface 250 permits the blade unit to pivot forward or rearward to the same extent during shaving, and is adapted to receive spring 145 to bias the cartridge within the range of overall rotation, e.g., through a 40 to 45 degree arc.

Now, the connection of the base 127 to the connecting portion 19 of handle 14 will be described, with reference to FIGS. 3-3A and 6-8.

Figure 7:
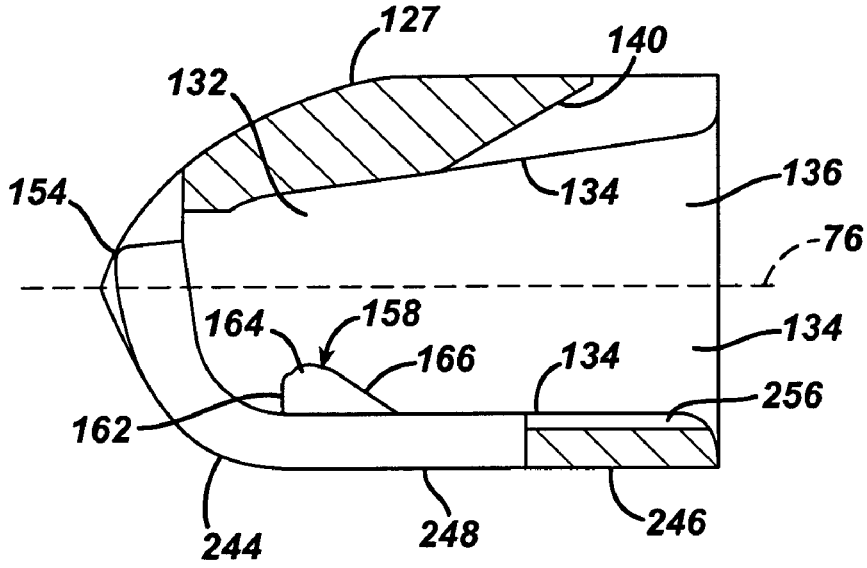
FIG. 7 is a cross-sectional view of the rear portion of the connecting member shown in FIGS. 3-3A.

Referring to FIGS. 3A and 7, base 127 has a handle-receiving region 132 that is partially defined by inwardly directed surfaces 134. Connection entrance 136 (FIG. 7) provides access to handle-receiving region 132. Inwardly directed surfaces 134 mate with outwardly directed surfaces 138 (FIG. 8) on extension 126 of handle 14. Base 127 also has an angled recess region 140 for receiving angled surface 142 on handle 14.

Figure 8:
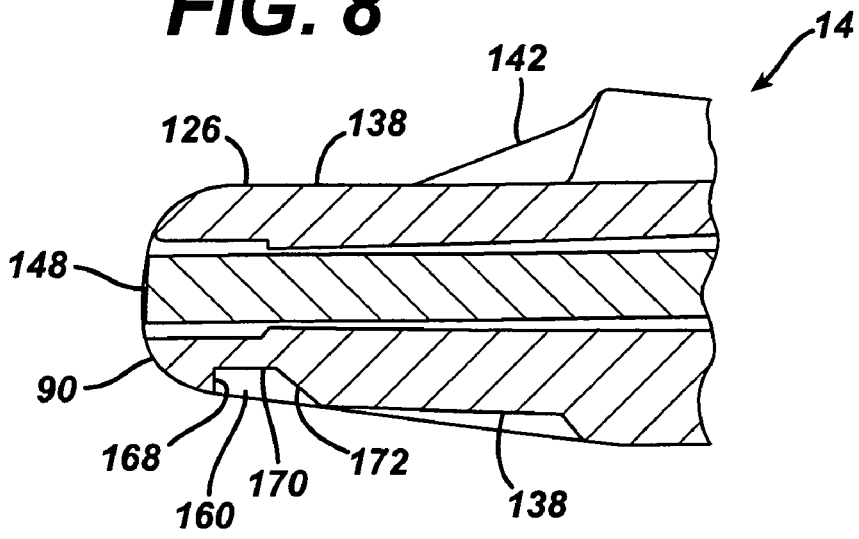
FIG. 8 is a cross-sectional view of the corresponding portion of the handle connecting structure shown in FIGS. 6-6A, taken along line 8-8 in FIG. 6A.

Referring to FIGS. 3A and 8, base 127 has a latching member 244 formed in the bottom wall 246 of the base. Latching member 244 has a cantilevered beam structure, and is connected to bottom wall 246 at base region 248. Latching member 244 tends to pivot upon being subjected to a force with an outward component at the free end at engagement members 154 (i.e., to the left along connection axis 76 in FIG. 7), as described in U.S. Pat. No. 5,956,851, incorporated by reference above. Bottom wall 246 also has grooves 256 to promote pivoting of latching member 44.

Two projections 158 (FIGS. 3A and 7) extend upward from latching member 244 for interacting with depressions 160 formed in the lower surface of extension 126 of handle 14 (FIG. 8). Each projection 158 has a front blocking surface 162, a top surface 164, and an angled camming surface 166, which makes about a 45 degree angle with connection axis 76 along which extension 126 moves during connection to and retraction from base 127. Other angles, e.g., between 30 and 60 degrees, could also be used. Depressions 160 similarly have front surfaces 168 for interacting with front blocking surface 162, top surface 170 and rear angled surface 172 for receiving top surface 164 and camming surface 166, respectively, of projections 158. Front blocking surface 162 of projection 158 makes about a 90 degree angle with connection axis 76.

The interaction of the components of handle 14 and cartridge 12 during connection and disconnection of cartridge 12 to handle 14 is discussed in further detail in U.S. Pat. No. 5,956,851, the disclosure of which is incorporated by reference above. Briefly, as extension 126 of handle 14 is moved into the handle-receiving region 132, sloping surface 90 (FIG. 8) of extension 126 rides over camming surface 166. This causes latch member 244, and in particular projection 158 thereon, to move downward along a deflection axis which is substantially perpendicular to connection axis 76 and the direction of insertion.

When sloping surface 90 has advanced past projection 158, and latching member 244 has moved up to the latched position in which projection 158 has snapped up into depression 160 of extension 126, cartridge 12 is securely attached to handle 14 with little likelihood of unintended detachment during use. The attachment is particularly secure due to interference of surface 168 (FIG. 8) on handle 14 with blocking surface 162 (FIG. 7) on cartridge 12. Surfaces 162 and 168 are substantially perpendicular to axis 76 along which extension 126 needs to be moved relative to base 127 to disconnect the two. Thus very large forces along axis 76 would need to be exerted to disconnect cartridge 12 from handle 14 if one does not first unlatch latching member 244.

Figure 6:
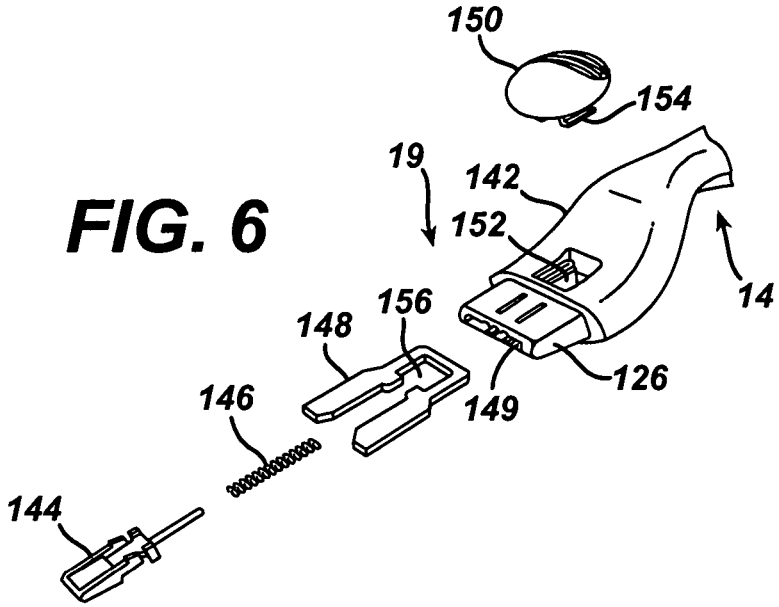
FIGS. 6-6B are, respectively, exploded, top and side views of a handle connecting structure at the upper end of the handle shown in FIG. 2.
Figure 6A:
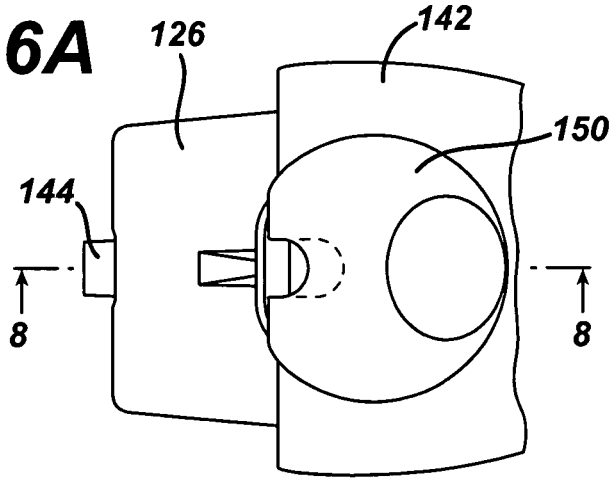
Figure 6B:
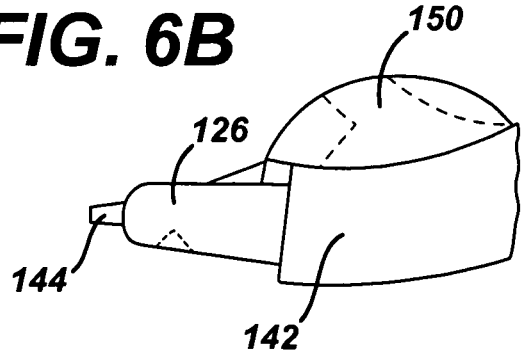

The connecting portion 19 of handle 14 is shown in detail in FIGS. 6-6B and 8. Referring to FIG. 6, a cartridge support structure 142 extends from the end of handle 14. Cartridge support structure 142 includes the trapezoidal extension 126, discussed above, and components that provide for ejection of cartridge 12 from handle 14.

Spring-biased plunger 144, spring 146, and U-shaped ejector 148 are received within recess 149 of cartridge support structure 142. Ejector button 150 is received in opening 152 on the top surface of support structure 142 and has bottom extensions 154 that are received within rectangular region 156 at the back narrow portion of ejector 148. These components are described in detail in U.S. Pat. No. 5,855,071, the disclosure of which was incorporated by reference above. Ejector 148 is slidably mounted within a recess within the handle connecting structure of handle 14, and can be moved forward slightly by activating button 150 on handle 14.

When the user wishes to disconnect cartridge 12 from handle 14, button 150 is moved relative to extension 126 in the unlatched direction, and this causes ejector 148 to be moved along axis 76 in the ejection direction. Ejector 148 (FIG. 8) pushes engagement members 154 outward, causing projection 158 to move downward as latching member 244 bends at base region 248. This downward movement causes projection 158 to clear depression 160 and to release extension 126 from latching member 244 so that extension 126 moves relative to base 127 in the retraction direction. A new cartridge may then be mounted on the handle by inserting the connecting portion 19 of the handle into the handle-receiving region 132 as discussed above.

A number of embodiments of the invention have been described. Nevertheless, it will be understood that various modifications may be made without departing from the spirit and scope of the invention. Accordingly, other embodiments are within the scope of the following claims.

What is claimed is:

1. A replaceable razor blade cartridge comprising:

a blade unit, and a cartridge connecting structure for connecting the blade unit to a handle, the cartridge connecting structure comprising a molded body, the cartridge connecting structure having inwardly directed surfaces that partially define a handle-receiving region and mate with outwardly directed surfaces on a handle connecting structure of the handle; and the cartridge connecting structure having a connection entrance to the handle-receiving region, and a projection that extends into the handle-receiving region, the projection having a blocking surface facing the opposite direction from the connection entrance to retain the handle connecting structure on the cartridge connecting structure; and the cartridge connecting structure also having a blade unit receiving portion having a shell bearing structure that pivotally receives the blade unit, the shell bearing structure comprising a pair of shell bearings; and the cartridge connecting structure having a spring return for biasing the blade unit relative to the cartridge connecting structure, the spring return being positioned between the shell bearings and extending integrally from the molded body of the cartridge connecting structure.

2. A cartridge of claim 1 wherein the blocking surface blocks retraction, of the handle connecting structure from the cartridge connecting structure when in a latched position and permits retraction of the handle connecting structure from the cartridge connecting structure when in an unlatched position.

3. A cartridge of claim 1 further including a latching member that includes an engagement structure that is movable from an initial position to a deflected position, the blocking surface moving from the latched position to the unlatched position as the engagement structure is moved from the initial position to the deflected position.

4. The cartridge of claim 3 wherein the handle connecting structure of the handle has an ejector that is extendible from the handle, and the engagement structure is aligned with the ejector.

5. The cartridge of claim 1 wherein the spring return includes a bent portion.

6. The cartridge of claim 1 wherein the cartridge connecting structure further includes a pair of arms that extend integrally from the molded body, and each of the shell bearings is positioned at a terminal end of a respective arm.

7. The cartridge of claim 1 wherein the cartridge connecting structure is configured so that the blade unit is biased only by the spring return.

8. The cartridge of claim 7 wherein the spring return extends from an outer surface of the molded body adjacent an end of the handle-receiving region of the cartridge connecting structure, defining a closed end of the handle-receiving region.

9. The cartridge of claim 1 wherein said blade unit comprises a primary blade and a rearward-most blade, said rearward-most blade being located rearward of said primary blade, and a pivot axis is located not forward of said primary blade and not rearward of said rearward-most blade.

* * * * *